United States Patent [19]

Ogden et al.

[11] 4,378,838

[45] Apr. 5, 1983

[54] PIPE WIPERS AND CUPS THEREFOR

[75] Inventors: James D. Ogden, Carrollton; Pat M. White, Lewisville, both of Tex.

[73] Assignee: Otis Engineering Corporation, Dallas, Tex.

[21] Appl. No.: 241,080

[22] Filed: Mar. 6, 1981

[51] Int. Cl.[3] ..... E21B 33/08

[52] U.S. Cl. ..... 166/153; 166/155; 166/156; 166/202

[58] Field of Search ..... 166/153, 154, 155, 156, 166/202; 15/104.06 R; 277/212 C, 215, 212 R

[56] References Cited

U.S. PATENT DOCUMENTS 3,605,896 9/1971 Perkins ..... 166/154 X 3,635,288 1/1972 Lebourg ..... 166/291 X 3,995,332 12/1976 Forchini et al. ..... 277/215 X

*Primary Examiner*—Stephen J. Novosad

*Assistant Examiner*—Thuy M. Bui

*Attorney, Agent, or Firm*—Albert W. Carroll

[57] ABSTRACT

An improved pipe wiper and cup therefor having at least one cup-like wiper lip which is strengthened by a plurality of radial webs which tend to keep the wiper lip from turning wrong side out, the wiper lip also having a plurality of external annular ridges whose diameters correspond to conventional pipe sizes so that the lip can be trimmed to proper size before use leaving an external ridge on the outer edge of the lip to enhance the wiping efficiency of the lip.

10 Claims, 5 Drawing Figures

PIPE WIPERS AND CUPS THEREFOR

BACKGROUND OF THE INVENTION

1. Field of the Invention

This invention relates to well cementing tools and more particularly to pipe wipers such as cementing plugs and pump-down plugs and to cups for use on such pipe wipers.

In cementing pipestrings such as casings and liners in well bores so that such pipestrings are firmly and sealingly bonded to the earth, cement slurry is pumped down such pipestring and followed by water until the slurry rises to the desired level in the well bore about the exterior of the pipestring, and then the slurry is allowed to stand until it hardens.

In some cases, a wiper plug is placed in the pipestring behind the cement slurry and ahead of the water to separate the two and to assure that all cement slurry is wiped from the inner wall of the pipestring.

In some wells, the pipestring which reaches the greatest depth does not extend to the earth's surface as do the other pipestrings. This lowermost pipestring is called a "liner," and its upper end is disposed within and suspended from the lower portion of the next outer pipestring. The liner usually has a liner hanger mechanism attached at its upper end, and this hanger is suspended from a liner hanger running tool attached to a running-in string, usually drill pipe, by which the liner is lowered into the well. Generally, in such cases, a liner wiper plug is releasably attached to the lower end of the liner hanger running tool within the liner, and this wiper plug has a longitudinal flow passage through it so that cement slurry and other fluids may be circulated downwards through the liner and upwards about its exterior. When the last of the cement slurry has been forced into the running-in string at the surface, a pumpdown wiper plug is launched into the flow stream and is pumped down the well ahead of water or other medium.

The pumpdown wiper plug wipes the inner wall of the running-in string free of cement slurry, and when it reaches the liner hanger running tool, it will lodge in the liner wiping plug, plugging its bore. This causes fluid pressure to increase above the wiper plugs, and when this pressure increases to a predetermined value, the liner wiper plug is released from the liner hanger. This rise and drop of fluid pressure as the pumpdown plug engages the liner wiper plug and the liner wiper plug is released is observable at the surface and indicates to the operator that the tail end of the cement slurry has entered the upper end of the liner. The liner wiper with the pumpdown wiper plug lodged in and plugging its bore now is pumped downwards in the liner and wipes the inner wall of the liner free of cement slurry.

Downward movement of the liner wiper plug is generally limited by a landing receptacle or latch down collar in which a forward or nose portion of the liner wiper latches and seals. Of course, when the liner wiper plug engages the latch down collar, the pump pressure rises abruptly, thus indicating to the operator that the tail end of the cement slurry has reached the lower end of the liner and that the cement slurry is in place surrounding the liner. When this slurry sets, it will bond the liner to the wall of the earth borehole. Afterwards, the slight amount of cement plugging the liner's lower end can be drilled out if desired. Of course, the liner wiper plug and the pumpdown plug must be drilled up also in such case, and for this reason the rigid or metallic portions thereof are formed of a readily drillable material such as aluminum.

Pipe wipers or wiper plugs for use in well cementing operations and particularly those used in cementing liners in place, and more particularly the pumpdown wiper plugs used in liner cementing operations have been a problem on occasion because their cup-like lips were too easily turned wrong side outward as in cases where the pumpdown plug lodged in the running-in string on the way down, or lodged in the liner hanger running tool but above the liner wiper plug. Pumpdown plugs have been known to malfunction in the launching mechanism at the surface when, due to faulty assembly or faulty operation of the launcher, the wiper cups turned wrong side outward at such low pressure differentials as to go unnoticed, and instead of following the cement slurry down, the plug stayed in the launcher. Thus, the cement slurry could not be spotted or placed in the desired location. Such malfunctions are understandably costly and time-consuming, and cement is very unforgiving.

2. Description of the Prior Art

Pipe wipers, such as the pumpdown plugs and wiper plugs used in operations in which casing strings and liners are cemented in place in wells, have appeared in various forms and made of various materials. Many of these plugs and wipers have had external annular flanges or lips formed of a resilient material such as an elastomer, usually a synthetic rubber. The annular lips were usually slanted rearwardly and in many cases resembled cups.

Examples of such wiper plugs and pumpdown plugs and equipment used therewith for cementing pipe strings in wells are typically shown in the following U.S. Patents: Nos.

1,822,193
1,994,072
2,165,433
3,437,137
3,545,542
3,605,896
3,616,850
3,635,288
3,796,260
3,910,349
3,934,652
3,948,322

U.S. Pat. Nos. 3,910,349 and 3,934,652 to Chudleigh B. Cochran disclose apparatus and methods for cementing well liners. Wiper plugs and pumpdown plugs are shown in each of these two patents.

U.S. Pat. No. 3,437,137 to Lyle B Scott shows wiper plugs for use in the process of cementing casing in wells.

U.S. Pat. No. 3,605,896 to Lee E. Perkins shows plugs used in the process of cementing pipestrings in wells, and in FIG. 4 of this patent there is illustrated a pumpdown plug which is the nearest prior art found relating to the present invention.

None of the prior patents found show or teach pipe wipers or cups having radially disposed webs for strengthening the flange of such devices to enable them to better resist forces tending to turn them wrong side outward.

SUMMARY OF THE INVENTION

The present invention is directed to pipe wipers, including wiper plugs, pumpdown wiper plugs, and the like, which include a rigid body surrounded by a resilient body having at least one annular flange which extends outwardly therefrom and is inclined or curved rearwardly and having a plurality of radially spaced web portions formed integral therewith which extend longitudinally between the resilient body and the flange to lend strength to the flange to enable it to resist greater forces which tend to turn it wrong side outward. The present invention is also directed to wiper cups for use on pipe wipers, including wiper plugs, pumpdown plugs, and the like. This invention is further directed to pipe wipers and cups therefor which are adapted for use in a variety of pipe sizes and which are readily trimmable to size before use.

It is therefore one object of this invention to provide an improved pipe wiper having at least one annular cup-like wiper lip with strengthening webs connecting the inner wall of such lip with the central body to enable such lip to resist greater forces which would tend to turn the cup-like lip wrong side outward.

Another object is to provide separate wiper cups of the character just described for use on mandrels of pipe wipers, including wiper plugs, pumpdown plugs, and the like.

A further object of this invention is to provide pipe wipers of the character described which may be readily trimmed or cut down to desired size to suit the size of pipe in which they are to be used.

BRIEF DESCRIPTION OF THE DRAWING

Additional objects and advantages may become apparent from reading the description which follows and from studying the accompanying drawing, wherein.

DESCRIPTION OF THE PREFERRED EMBODIMENTS

Figure 1A:
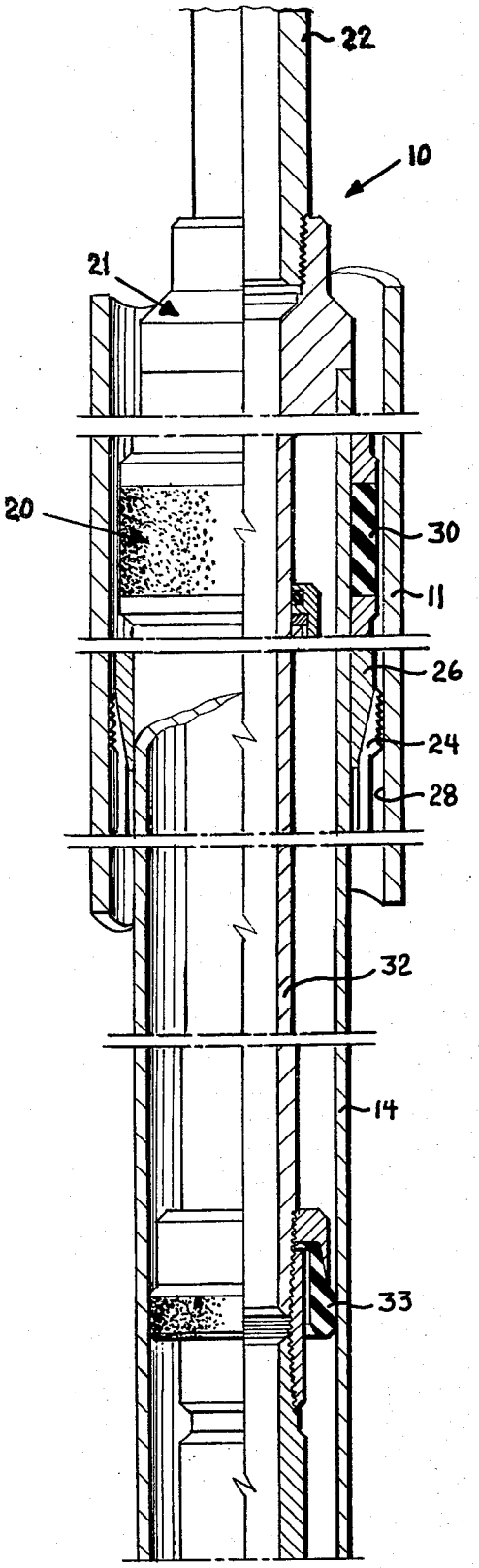
FIG. 1A and 1B taken together constitute a schematical view (FIG. 1B being a lower continuation of FIG. 1A) of the lower portion of a well showing a liner hanger anchored, but not sealed, in the lower portion of the well casing and with the liner hanger running tool still attached to the liner hanger.
Figure 1B:
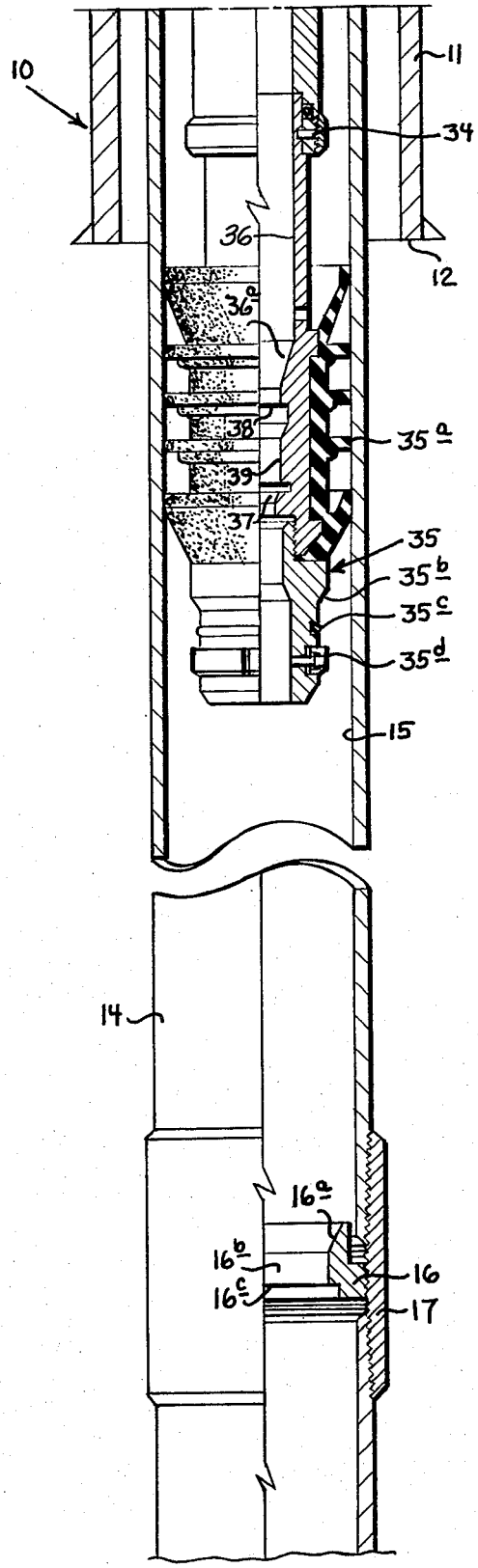

Referring now to FIGS. 1A and 1B, it will be seen that these fragmentary views taken together show a well 10 having a well casing 11 whose lower end 12 terminates say hundreds of feet above the bottom (not shown) of the well. A liner 14, having a latch down receptacle 16 threadedly disposed in collar 17 which is preferably spaced only about 20 to 40 feet above the bottom of the liner 14, is telescopingly anchored in the well casing a short distance above the lower end 12 thereof.

The liner 14 is anchored in the well casing 11 by a liner hanger 20 attached to its upper end by means which are not shown but which are well known to those skilled in the art. The liner 14 and the liner hanger 20 have just been lowered into the well on a liner hanger running tool 21 attached to a suitable running-in string 22 such as a string of drill pipe, or the like. The liner hanger has been partially actuated to force its slips 24 and its expander 26 into engagement to expand the slips into biting engagement with the inner wall 28 of the well casing, enabling the thus locked liner hanger to support the liner 14 suspended therefrom. The seal means 30 of the liner hanger 20 is not as yet expanded so that circulation of fluid therepast may be had.

The liner hanger running tool 21 includes a tubular mandrel 32 on which is disposed a packer cup 33 intermediate its ends, while on its lower end is releasably attached, by shear pins 34, a pipe wiper or liner wiper plug 35. The liner wiper plug has a flow passage 36 extending therethrough whose lower end opens into the liner bore.

Cement slurry is pumped down the running-in string 22, through the liner hanger running tool 21, the liner hanger 20, and through the liner 14 into the open well bore (not shown) therebelow and rises in the well bore around the liner and liner hanger. Water conventionally goes ahead of and behind the cement slurry. During circulation of the water and cement slurry, the packer cup 33 assures that these fluids after exiting the running tool 20 will continue downwards through the liner 14. After the cement slurry has been disposed exterior of the liner and liner hanger, the liner hanger seal means 30 are expanded to seal between the hanger 20 and the casing 11, then the running tool is disengaged from the liner hanger and withdrawn from the well.

In order to leave no cement on the inner walls of the running-in string 22 and the liner 14, pipe wipers are used. One pipe wiper, the liner wiper plug 35, is releasably attached to the lower end of the liner hanger running tool 20. Another wiper of the type taught in U.S. Pat. No. 3,605,896, is pumped down the running-in string 22 and wipes the cement from the inner wall of the running-in string and running tool. This type of pipe wiper carries a stop shoulder together with latching and sealing means and upon reaching the liner wiper plug 35, lodges and latches therein and plugs the bore thereof. As pumping continues, a pressure drop across the latched-together pair of wipers develops and the pins 34 shear to release them for downward movement through the liner. The external lips or flanges 35*a* on the liner wiper wipe the inner wall of the liner. This liner wiper plug 35 is adapted to lodge, latch, and seal in the latch down receptacle 16 to plug the liner at that location and prevent further flow therethrough.

More specifically, the liner wiper plug 35 has an upwardly facing stop shoulder 37 formed in its bore 36. Also, a downwardly facing latch shoulder 38 is provided above the stop shoulder 37, while between these two shoulders a smooth bore wall 39 is provided. The pipe wiper 40 seen in FIGS. 2 and 3 cooperates with the liner wiper plug 35 in a manner to be described hereinafter.

Figure 2:
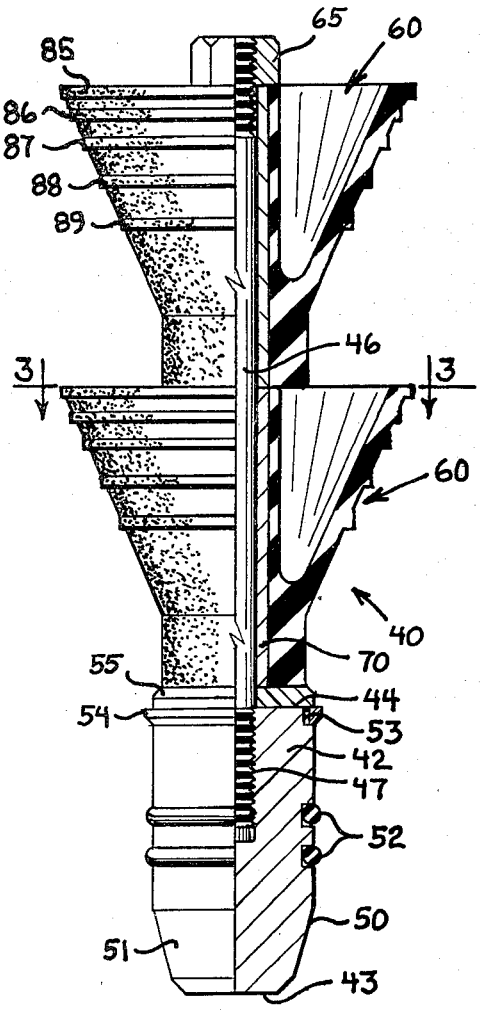
FIG. 2 is a view, partly in section and partly in elevation, showing a pipe wiper constructed in accordance with the present invention.

The pipe wiper 40 is shown in FIG. 2 to include a mandrel 41 comprising a nose section 42, having a forward end 43 and a rearward end 44, and including a rod 46 threadedly attached to the rearward end of the nose section 42 as by threads 47. The nose section is tapered as at 50 to provide a stop shoulder 51. A pair of external annular grooves are provided as shown in which are disposed a pair of seal rings such as O-rings 52. The extreme rearward end of the nose section is reduced in diameter to provide a recess 53 in which is disposed latch ring 54 which is inherently expanded but which is contractible to a diameter approximating that of the largest diameter of the nose section. The latch ring 54 is preferably a C-ring having an external chamfer on its forward side and a substantially square corner on its rearward outer corner. A special washer or spacer ring 55 whose forward external corner is square and whose outside diameter approximates that of the nose section is placed about the rod 46 and abutted against the rearward end of the nose section to retain the latch ring in place as shown.

A pair of wiper cups 60 is disposed on the rod as shown and are abutted against the rearward side of the washer 55. The washer 55 thus completes the latch ring recess 53, and completes the nose section and constitutes an abutment shoulder to support the wiper cups 60. A nut 65 is threaded onto the rearward end of the rod 46 as shown to hold the wiper cups on the rod and to maintain them in engagement with the abutment shoulder or washer 55.

During a liner setting and cementing operation, the pipe wiper 40 (also called pumpdown plug) wipes the inner walls of the running-in string 22 and the liner hanger running tool 21, then arrives at the pipe wiper 35 (also called a liner wiper plug). On downward movement of the nose section 42 of the pipe wiper 40 into the bore 36 of pipe wiper 35, the stop shoulder 51 of the nose section engages upwardly facing stop shoulder 37 in the wiper 35 and this stops descent of the pipe wiper 40. Just before these two shoulders engage, the latch ring 54 is contracted by inward camming action of the tapered bore **36*a* and then expands again when it gets below the downwardly facing shoulder 38. Thus, the square shoulder at the upper outer corner of the latch ring is latched below the abrupt internal shoulder 38, thus latching the two pipe wipers together with the O-rings 52 sealingly engaged in the smooth bore 39. Thus, pipe wiper 40 is latched into and sealingly plugs the bore through pipe wiper 35. The plugging of bore 36 of pipe wiper 35 stops the flow of fluids through the liner hanger running tool, but as pumping continues, pressure builds above the pipe wipers and when the differential pressure reaches a predetermined value, the pins 34 are sheared and the latched-together pipe wipers move downwardly through the liner 14** wiping its inner walls as they go.

The pipe wiper 35 is provided on its reduced lower portion with a stop shoulder **35*b*, a seal ring 35*c* and spring-loaded latch dogs 35*d* which cooperate with the latch down collar 16 disposed in coupling 17 near the lower end of the liner 14. When the two pipe wipers reach the latch down collar 16, the lower end of pipe wiper 35 engages the flared portion 16*a* of bore 16*b* and is guided into the bore 16*b*. During this travel, the flared bore 16*a* causes the latch dogs 35*d* to move inwardly to retracted position. When these latch dogs get below downwardly facing latch shoulder 16*c* in the latch down collar, they expand and latch the pipe wiper 35 in the latch down collar. The downwardly facing stop shoulder 35*b* of the wiper 35 engages the upwardly facing shoulder 16*a* to limit downward movement of the wiper 35 relative to the collar 16 and the seal ring 35*c* of the wiper is at this time sealingly engaged in bore 16*b* to plug the same. The latch down collar 16** is thus plugged so that flow cannot take place therethrough in either longitudinal direction. This will maintain the cement slurry in place while it hardens.

Figure 4:
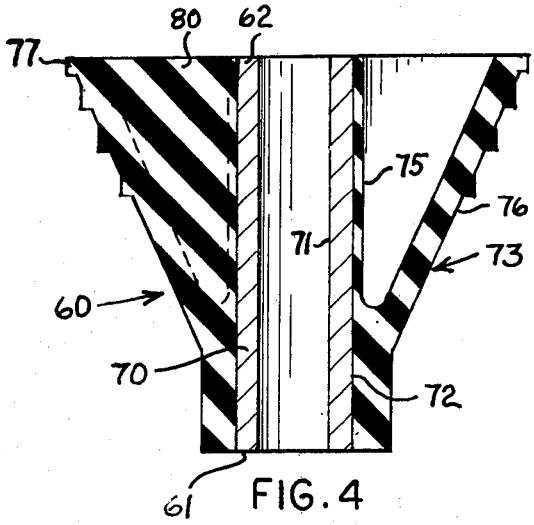
FIG. 4 is a cross-sectional view taken along line 4—4 of FIG. 3 but showing the cup only.
Figure 3:
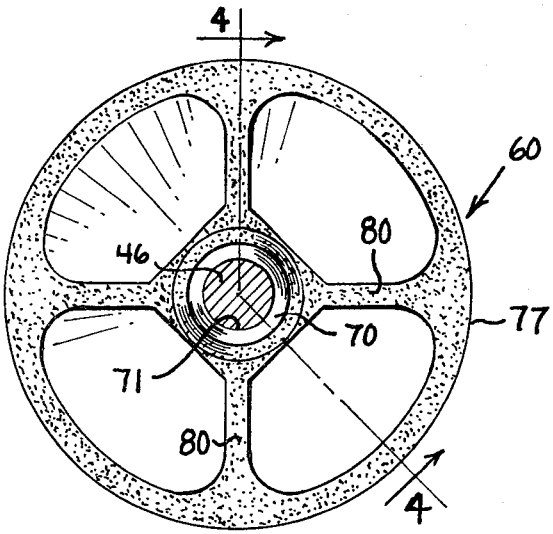
FIG. 3 is a cross-sectional view (slightly magnified) taken along line 3—3 of FIG. 2.

As seen in FIGS. 3 and 4, each wiper cup 60 has an elongate rigid tubular thimble or body 70, having a bore 71 adapted to receive the rod 46. The thimble is preferably made of aluminum because it generally needs to be drilled to bits after the cement slurry in the well has set, but it could be made of any suitable rigid material. Bonded or otherwise attached to the lateral exterior surface 72 of the thimble 70 is a resilient body or cup member 73 having a tubular body 75 extending the full length of the thimble 70 and having an external fin or external flange 76 thereon which extends outwardly and rearwardly, its ridged outer edge 77 forming a lip adapted to wipe the inner wall of a pipe through whose bore the pipe wiper is moved. The thimble is long to provide ample bonding surface to hold the resilient body 73 firmly anchored thereto.

The wiper cup 60 is easily moldable and is preferably made of a suitable elastomeric material such as nitrile rubber or other similar material. The wiper cup illustrated in FIGS. 2–4 has a forward end 61 and a rearward end 62 and was made by molding a body 73 of nitrile rubber to the outside of the thimble using a suitable mold. The body of elastomeric material has a tubular central portion bonded to the exterior of the thimble and has an external cup-like flange or lip extending outwardly and rearwardly.

To strengthen the resilient body 73 so that its cup portion or flange 76 will better resist forces tending to turn it wrong side out, a plurality of radially disposed, circumferentially spaced webs 80 are formed integral with the flange 76 and the tubular body 75 of the cup, as shown. Thus, when the cup is subjected to forces which tend to turn it wrong side out, the plurality of webs provide much added strength to resist such forces. Any number of such webs may be molded into the cup, but reason would dictate that there should be at least three and that for ordinary pipe sizes four to eight would likely be ideal while an impractically high number might soon thereafter be reached.

Cups without webs such as webs 80 have been used in the past and it was found that they turned wrong side out at low pressure differentials of approximately 20 to 25 pounds per square inch. It seemed reasonable to increase their strength by increasing the durometer or hardness of its resilient material. It was found that increasing the durometer from about 65 to as much as 90 failed to strengthen the cup as much as desired. Cups of about 90 durometer failed at only about 50 to 60 pounds per square inch differential pressure. Cups with thicker walls were also tried, and it was found that increasing their wall thickness had little affect on their performance. Cups of about 65 durometer and having four webs as shown in FIGS. 2–4, on the other hand, withstood up to about 250 pounds per square inch differential pressure before failing. It can readily be seen that the webs add appreciable strength to the cups.

Cups with much shorter thimbles than the thimble 70 of cup 60 have been known in the past and are old. They failed often. Thimbles of increased length, such as the thimble 70, provide a commensurately larger lateral area for bonding to the elastomeric material and thus enhance their strength and performance appreciably.

Any number of cups such as cup 60 can be used, however, two are generally used on a pipe wiper device, as shown in FIG. 2, and this number has been found to perform very satisfactorily.

Since many different sizes of pipe are used as running-in strings for liner setting operations, different sizes of cups are needed. For this reason, cup 60 may be molded with a series of longitudinally spaced external annular ridges about its circumference, such as the ridges 85, 86, 87, 88, and 89. Each of these ridges is sized to fit a certain size of pipe bore. When a cup is to be used to wipe the inner wall of a pipe whose bore requires a cup size corresponding to say ridge 87, then the cup is trimmed with a knife to remove the cone-like portion of the cup 76 rearwardly of ridge 87 together with a portion of the webs 80. The pipe sizes accommodated by each ridge may be molded into the outer surface of the cup next to or just forward of each ridge. Such ridges are old and well known in the liner cementing art. Thus, a cup may be useable in a rather wide range of pipe sizes.

Thus, it has been shown that the pipe wiper device and the cups therefor illustrated and described herein above fulfill all of the objects of the invention which were set forth at the outset. It has been shown that an improved pipe wiper has been provided which has at least one cup-like wiper lip which is strengthened by a plurality of radially spaced, longitudinally extending webs which enable the cup-like lip to resist greater forces which tend to turn the lip wrong side out; that separate easily molded cups have been provided so that any number of the same may be used on a wiper device as desired and that each cup is molded or otherwise attached or bonded to a thimble and has a cup-like wiper lip which is strengthened by a plurality of web which help to keep the cup-like lip from turning wrong side out by normal pressure differentials created across the cup during normal operation; and that the wiper devices and cups of the character described may be formed with a plurality of longitudinally spaced external annular ridges whose diameters correspond to different pipe sizes so that such cups may be readily trimmed to the proper size for the pipe string in which such cup is to be used, and that when so trimmed, a ridge remains at the outer edge of the cup to enhance its efficiency as a wiper.

It should be understood that, if desired, a pipe wiper embodying this invention could be formed of a body of suitable resilient material molded with cup-like flanges with strengthening webs. Alternatively, a wiper plug could be made by molding a body of suitable resilient material around, and even encapsulating, a central rigid body of suitable material such as metal, hard plastic, or the like, the resilient body being formed with cup-like flanges with strengthening fins. In either case, the claims appended hereto anticipate such pipe wiper structures and such pipe wipers are understood to fall within the scope of the appended claims.

The foregoing description and drawings of the invention are explanatory and illustrative thereof, and various changes in sizes, shapes, materials, and arrangement of parts, as well as certain details of the illustrated construction, may be made within the scope of the appended claims without departing from the true spirit of the invention.

We claim:

1. A pipe wiper, comprising:

a. a body;

b. at least one resilient external annular cup-like flange on said body extending outwardly and rearwardly; and c. a plurality of radially disposed, longitudinally extending webs integral with said body and said flange for strengthening said flange to better resist being turned wrong side out.

2. The pipe wiper of claim 1, wherein said body is formed of a rigid material and said resilient flange is formed of an elastomeric material bonded to the exterior of said body.

3. The pipe wiper of claim 2, wherein said body is formed of a metallic material and has a nose portion formed on its forward end providing a downwardly facing shoulder engageable with an upwardly facing shoulder in a pipe string.

4. The pipe wiper of claim 3, wherein said nose portion of said body includes:

a. first annular groove means formed in the exterior surface of said nose portion;

b. resilient seal ring means in said first groove means adapted to sealingly engage in a receptacle in a pipe string;

c. second annular groove means formed in the exterior surface of said nose portion; and d. latch ring means in said groove means adapted to engage below a latch shoulder to anchor said pipe wiper in the pipe string.

5. A pipe wiper device, comprising:

a. an elongate rigid mandrel having a support shoulder thereon;

b. resilient wiper means on said mandrel abutted against said support shoulder, said resilient wiper means having a body with at least one external annular flange extending outwardly and rearwardly to form a wiper lip to engage the internal wall of a pipe string;

c. a plurality of strengthening webs extending radially between said body and said at least one flange and being integral therewith for retaining said at least one flange in proper shape for wiping the inner wall of said pipe string; and d. means on said mandrel for holding said wiper means abutted against said abutment shoulder.

6. A pipe wiper, comprising:

a. an elongate mandrel having an enlarged nose portion on its forward end providing a rearwardly facing shoulder;

b. resilient wiper means mounted on said mandrel and engaging said rearwardly facing shoulder, said resilient wiper means including at least one wiper cup, each of said at least one wiper cup comprising:

i. a rigid tubular body;

ii. a resilient body surrounding said rigid tubular body and attached thereto, said resilient body having a tubular portion with an annular flange extending outwardly and rearwardly when said wiper means is mounted on said elongate mandrel, the outer edge or rim of said flange providing a lip adapted to engage the inner wall of a pipe string; and iii. a plurality of radially disposed, longitudinally extending webs formed integral with said tubular portion and said flange for strengthening said flange to better resist being turned wrong side out; and e. means on said elongate mandrel for holding said resilient wiper means in engagement with said rearwardly facing shoulder of said nose portion.

7. The pipe wiper of claim 6, wherein said nose portion includes:

a. stop shoulder means on said nose portion;

b. resilient seal means on said nose portion;

c. latch means on said nose portion; and d. whereby said pipe wiper is adapted to engage, seal, and latch in a receptacle in a pipe string, said receptacle having an upwardly facing shoulder, a seal bore, and a latch recess.

8. A wiper cup for use on a pipe wiper, comprising:

a. a rigid tubular body;

b. a resilient body formed with a tubular portion having a forward end and a rearward end surrounding and attached to said rigid tubular body and having an annular flange thereon extending outwardly and rearwardly, the outer edge or rim of said flange being adapted to engage and wipe the inner wall of a pipe string as the pipe wiper is moved forwardly therethrough; and c. a plurality of radially disposed, longitudinally extending webs formed integral with said tubular portion and said external flange of said resilient body, said webs enabling said resilient body to better retain its original shape and resist being turned wrong side outward.

9. The wiper cup of claim 8, wherein said resilient body is molded of an elastomeric material and has its tubular portion bonded to the exterior lateral surface of said rigid tubular body.

10. The wiper cup of claim 9, wherein said external flange is formed with a plurality of annular longitudinally spaced ridges in its outer frusto-conical surface, each such ridge having a predetermined diameter equal to a cup diameter proper for use in a different size of pipe and indicating various sizes of pipe for which said cup is adaptable, said ridges serving as a guide for removal of the unneeded rearward portion thereof prior to use in a pipe string of smaller internal diameter than that for which said cup was theretofore adapted.

* * * * *